US007190248B2

(12) United States Patent
Coleman, Jr. et al.

(10) Patent No.: US 7,190,248 B2
(45) Date of Patent: Mar. 13, 2007

(54) HOLDER FOR FERROUS OBJECTS, ESPECIALLY A MAGNETIC SOCKET DRAWER

(75) Inventors: Edward S. Coleman, Jr., Ridgefield, CT (US); Stanley S. Stromski, Riverhead, NY (US)

(73) Assignee: Ullman Devices Corporation, Ridgefield, CT (US)

( * ) Notice: Subject to any disclaimer, the term of this patent is extended or adjusted under 35 U.S.C. 154(b) by 0 days.

(21) Appl. No.: 10/976,485

(22) Filed: Oct. 29, 2004

(65) Prior Publication Data

US 2006/0091986 A1 May 4, 2006

(51) Int. Cl.
*H01F 7/20* (2006.01)
*A45C 11/26* (2006.01)

(52) U.S. Cl. ..... 335/285; 206/350; 206/818

(58) Field of Classification Search ..... 335/285, 335/302, 306; 206/350, 818; 211/DIG. 1
See application file for complete search history.

(56) References Cited

U.S. PATENT DOCUMENTS 2,958,019 A * 10/1960 Scholten et al. ..... 335/285
3,111,736 A 11/1963 Budreck
4,489,994 A * 12/1984 Williams ..... 312/119
4,802,580 A 2/1989 Andersen
5,228,570 A 7/1993 Robinson
5,316,143 A 5/1994 Horn
5,456,359 A 10/1995 Horn
5,501,342 A 3/1996 Geibel
5,544,747 A 8/1996 Horn
5,573,116 A * 11/1996 Zink ..... 206/378
5,669,516 A * 9/1997 Horn ..... 211/70.6
5,701,640 A * 12/1997 Locher ..... 24/303
5,743,394 A 4/1998 Martin
5,896,729 A 4/1999 Bell et al.
6,006,906 A 12/1999 Winnard
6,073,766 A 6/2000 Winnard
6,092,655 A 7/2000 Ernst
6,095,329 A 8/2000 Kao
6,098,799 A 8/2000 Lee
6,571,669 B2 6/2003 Benatz et al.
6,571,966 B1 6/2003 Hsiao
6,614,337 B1 9/2003 Winnard

* cited by examiner

*Primary Examiner*—Ramon M. Barrera

(57) ABSTRACT

A holder for ferrous object, comprising: a holder body formed of a ferrous material and having at least one channel, the channel having a width and a depth; and a plurality of magnet members positioned in the at least one channel, the holder body and magnet members defining, in combination, a holding surface for magnetically securing ferrous objects.

10 Claims, 3 Drawing Sheets

HOLDER FOR FERROUS OBJECTS, ESPECIALLY A MAGNETIC SOCKET DRAWER

BACKGROUND OF THE INVENTION

The invention relates to a holder for ferrous objects, and more particularly to a magnetic socket drawer for holding and magnetically securing tools such as sockets for a socket wrench, and the like.

Proper storage of tools is a common problem for mechanics, homeowners and the like, and tools are frequently kept in a disorganized fashion, and in ways which allow easy loss of such tools.

While various different toolboxes, holders and the like have been provided for storing tools, the need remains for tool storage which provides easy organization and securing of various tools, especially of magnetic tools such as sockets for a socket wrench set.

It is the primary object of the present invention to provide such a holder.

Other objects and advantages of the present invention will appear below.

SUMMARY OF THE INVENTION

In accordance with the present invention, the foregoing objects and advantages have been readily attained.

According to the invention, a holder is provided for ferrous objects, which holder comprises a holder body formed of a ferrous material and having at least one channel, the channel having a width and a depth; and a plurality of magnet members positioned in the at least one channel, the holder body and magnet members defining, in combination, a holding surface for magnetically securing ferrous objects.

In further accordance with the invention, the holder can be provided in the form of a drawer, which can advantageously be slidably positioned within a cabinet, to allow for further ease in storage of ferrous objects such as sockets and the like.

BRIEF DESCRIPTION OF THE DRAWINGS

A detailed description of preferred embodiments of the present invention follows, with reference to the attached drawings, wherein.

DETAILED DESCRIPTION

The invention relates to a holder for ferrous objects and, more particularly, to a magnetic socket drawer for magnetically organizing and securing ferrous objects such as sockets for socket wrench sets.

Figure 1:
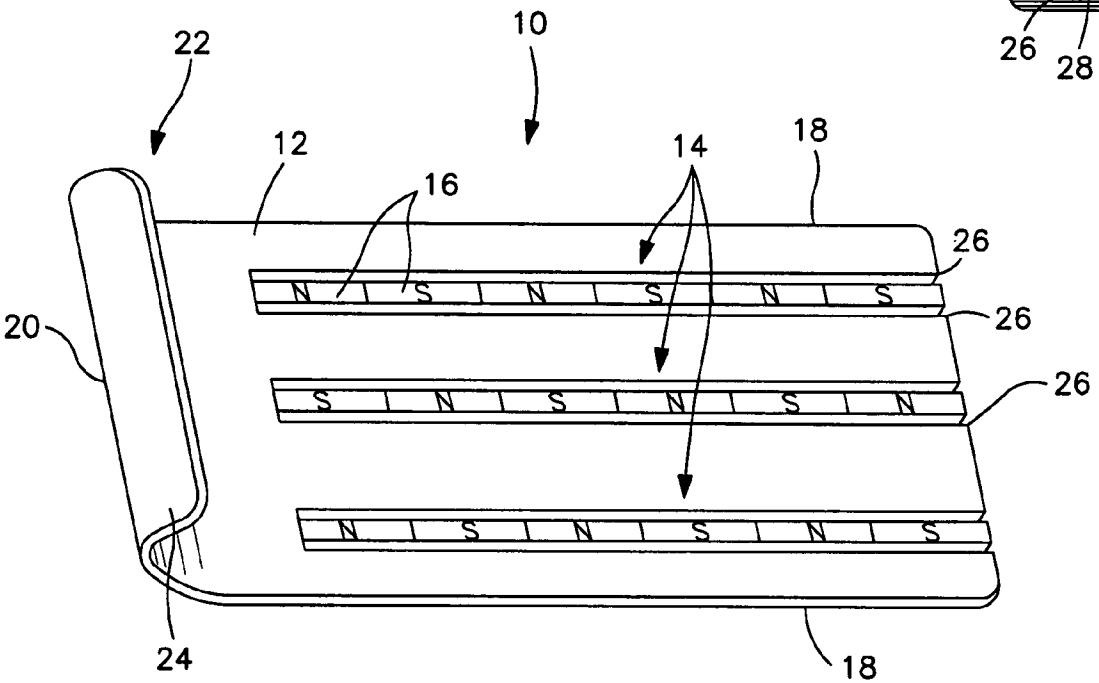
FIG. 1 is a perspective view of a holder for ferrous objects in accordance with the present invention.

FIG. 1 shows a holder 10 having a holder body 12 with a plurality of channels 14 defined therein. A plurality of magnets 16 are positioned within channels 14 and serve, in combination with the flat surface of holder body 12, to define a holding surface for magnetically securing ferrous objects.

Holder body 12 is advantageously a substantially rectangular member, having two long sides 18 and two short sides 20. In accordance with the invention, holder body 12 is advantageously provided of a ferrous material, preferably steel, and more preferably 20 gauge steel.

Holder body 12 can advantageously be provided with a gripping member 22, which in this embodiment is in the form of a hook 24. Hook 24 advantageously curves upwardly and back toward an opposed short side 20, from a first short side 20, as is shown in FIG. 1. Gripping member 22 advantageously serves to allow holder 10 to be easily carried, and also allows for hanging of holder 10 from various other supports, if desired.

Magnets 16 can be any suitable type of magnet, and magnets are preferably selected to provide sufficient holding power to securely hold the ferrous objects which are to be positioned thereon. In accordance with a preferred embodiment of the invention, magnets 16 are advantageously provided having opposed flat surfaces defining north and south pole surfaces, and magnets 16 are advantageously positioned end to end in channels 14 with alternating north and south pole surfaces. These alternating surfaces have been found to provide a remarkably strong holding surface for magnetically securing ferrous objects such as sockets and the like.

Figure 2:
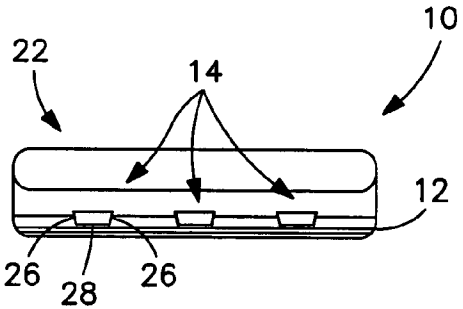
FIG. 2 is an end view of the holder of FIG. 1.

FIG. 2 shows an end view of holder 10 in accordance with the present invention, and shows holder 10 having three channels 14, spaced from each other and positioned substantially parallel to each other, for holding the desired sockets. Each channel 14 is advantageously defined by two channel sidewalls 26 and a channel bottom 28. Sidewalls 26 advantageously slope away from each other in a direction away from bottom 28.

Channels 14 advantageously have a width w and a height h, as shown in FIG. 2, and magnets 16 are advantageously selected having a thickness sufficient to position an upper surface of magnet 16 substantially co-planar with the upper surface of holder body 12. This advantageously strengthens the hold provided by magnets 16 and holder body 12 in combination.

Magnets 16 can be glued within channels 14 if necessary or desired, or can be held within channels 14 in any other manner as well, for example through rivets, or magnetic hold, or any other type of structure.

Channels 14 can advantageously be formed in holder body 12 so that they extend entirely to one short side 20, but not to the other.

Figure 3:
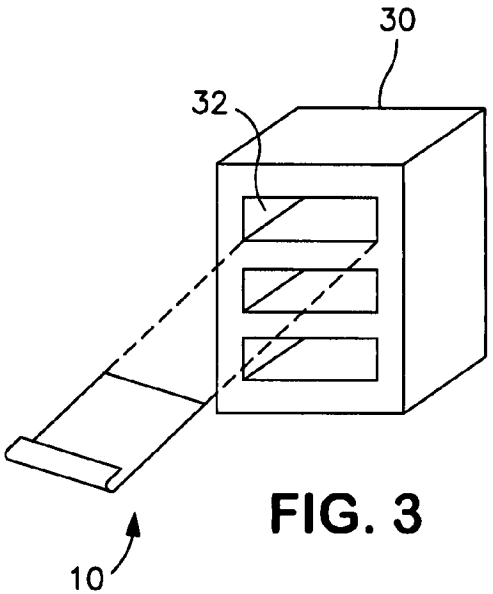
FIG. 3 is a perspective view showing a cabinet with a holder in accordance with the present invention slidably positioned therein.

In further accordance with the invention, and as shown in FIG. 3, holder 10 can be incorporated into a tool cabinet 30, wherein tool cabinet 30 has drawer slots 32 adapted for receiving drawers. Holder 10 in this embodiment can be positioned within drawer slots 32, preferably slidably positioned, so that holder 10 can be slid out of drawer slot 32 to allow easy access to tools or other objects held thereon.

Figure 4:
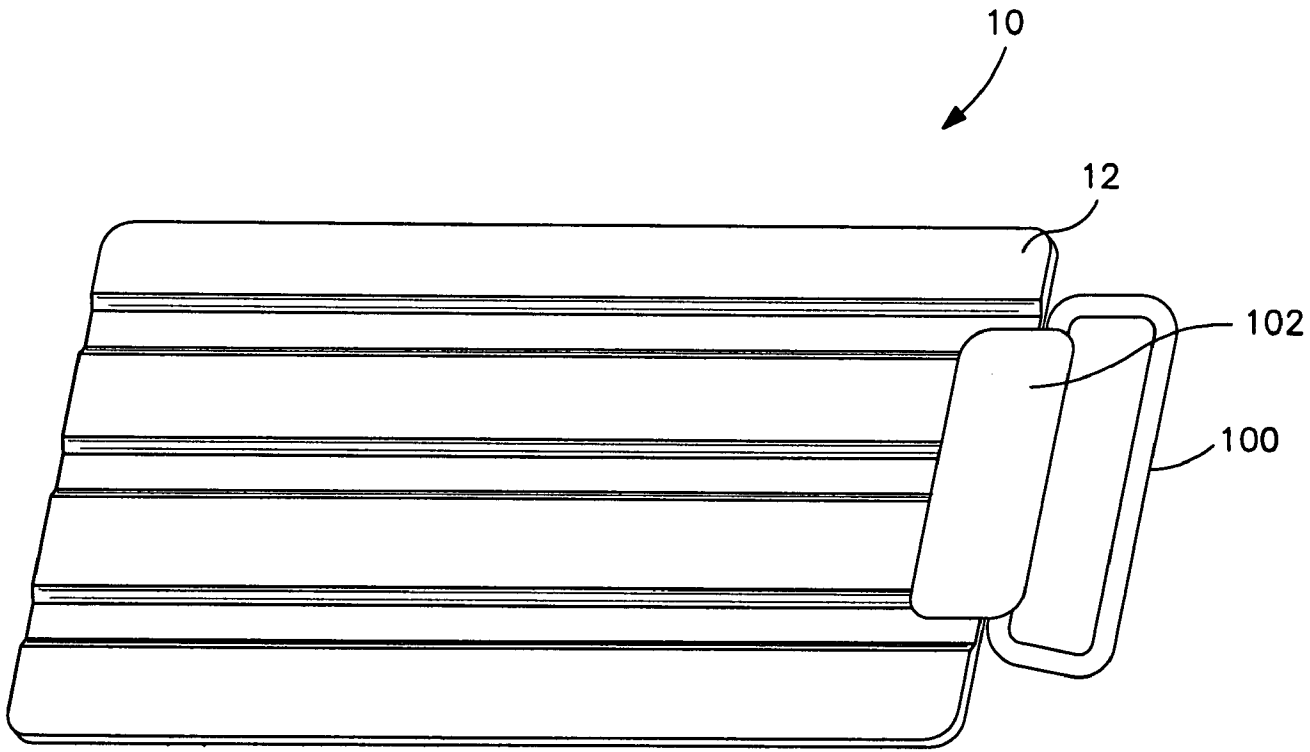
FIGS. 4 and 5 illustrate alternate handle members according to the invention.

Referring to FIG. 4, holder 10 according to the invention can alternatively be provided with a grip member in the form of a ring member 100 which can advantageously be pivotably mounted relative to holder body 12. In this embodiment, ring member 100 is a substantially rectangular shaped piece of material, for example steel wire, which is preferably itself substantially rigid, but which is pivotably held by a bracket member 102 which is attached to holder body 12 as shown.

Figure 5:
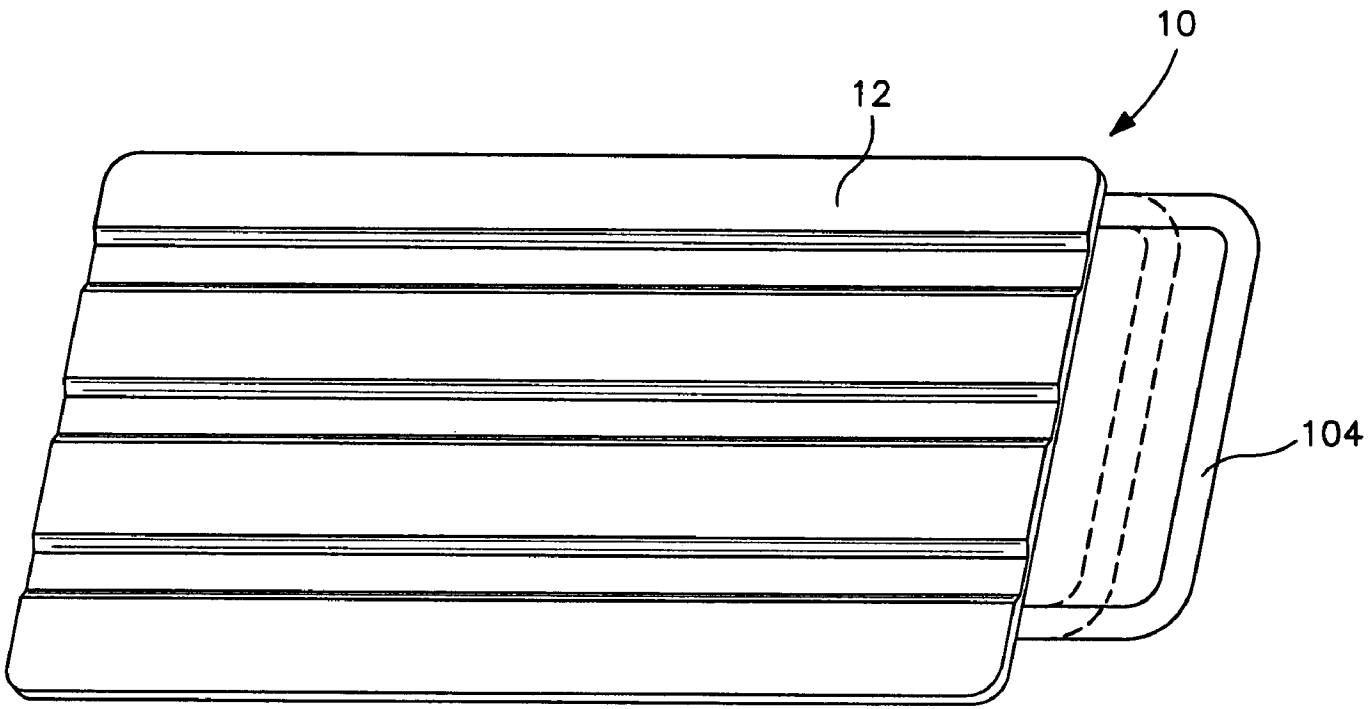

FIG. 5 shows a further embodiment wherein holder 10 has a grip member in the form of a ring member 104 which is slidably mounted relative to holder body 12, for example in tracks on the underside of holder body 12 or in brackets mounted to the bottom of holder body 12, as desired. This allows ring member 104 to be positioned between an extended position as illustrated in solid lines and a withdrawn position as illustrated in dashed lines in FIG. 5.

It should be appreciated that a holder has been provided in accordance with the present invention which allows for excellent organization and secure holding of tools such as sockets for a socket wrench kit and the like. It should also be appreciated that although the embodiment of the present invention is shown having a hook or curved member for the gripping member, this member can be provided of any other shape as well.

Still further, the embodiment shown in these drawings includes three substantially parallel channels 14. Holder 10 can of course be provided having fewer or more channels, depending upon the specific size or dimension of holder 10 to be used.

It is to be understood that the invention is not limited to the illustrations described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. A holder for ferrous object, comprising:

a holder body formed of a ferrous material and having at least one channel, the channel having a width and a depth, wherein the at least one channel is defined by channel side walls and a channel bottom, and wherein the channel side walls slope away from each other in a direction away from the channel bottom; and a plurality of magnet members positioned in the at least one channel between the channel side walls, the holder body and magnet members defining, in combination, a holding surface for magnetically securing ferrous objects.

2. The holder of claim 1, wherein the magnet members comprise a plurality of magnets each having opposed flat surfaces defining north and south pole surfaces, and wherein the magnets are positioned along the channel with alternating north and south pole surfaces defining the holding surface.

3. The holder of claim 1, wherein the holder body has a plurality of substantially parallel channels and substantially flat portions extending laterally between the substantially parallel channels.

4. The holder of claim 3, wherein the substantially flat portions of the holder body define an upper surface of the holder body, and wherein the magnet members have an upper surface, and wherein the magnet members are positioned in the channels with the upper surface of the holder body co-planar with the upper surface of the magnets members.

5. The holder of claim 1, wherein the holder body has a grip member at one edge to facilitate use as a drawer.

6. The holder of claim 5, wherein the grip member comprises a curled portion along the one edge of the holder body.

7. The holder of claim 5, wherein the grip member comprises a ring member pivotably mounted relative to the holder body.

8. The holder of claim 5, wherein the grip member comprises a ring member slidably mounted relative to the holder body.

9. The holder of claim 1, wherein the holder body comprises 20 gauge steel.

10. The holder of claim 1, further comprising a tool cabinet having at least one drawer slot, and wherein the holder body is slidably positioned within the drawer slot.

* * * * *